US008511674B2

(12) United States Patent
Koga

(10) Patent No.: US 8,511,674 B2
(45) Date of Patent: Aug. 20, 2013

(54) SHEET FEEDING APPARATUS AND IMAGE FORMING APPARATUS WITH RETARD ROLLER

(75) Inventor: Hiroto Koga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/307,130

(22) Filed: Nov. 30, 2011

(65) Prior Publication Data

US 2012/0153561 A1 Jun. 21, 2012

(30) Foreign Application Priority Data

Dec. 17, 2010 (JP) ..... 2010-281485

(51) Int. Cl.
*B65H 3/52* (2006.01)

(52) U.S. Cl.
USPC ..... 271/122

(58) Field of Classification Search
USPC ..... 271/122, 125, 273, 274
See application file for complete search history.

(56) References Cited

U.S. PATENT DOCUMENTS

| | | | | |
|---|---|---|---|---|
| 5,996,990 | A * | 12/1999 | Kawashima | 271/122 |
| 6,298,214 | B1 | 10/2001 | Koga | |
| 6,823,154 | B2 | 11/2004 | Koga et al. | |
| 6,942,210 | B2 * | 9/2005 | Kawasumi | 271/125 |
| 6,955,348 | B2 | 10/2005 | Koga | |
| 6,962,333 | B2 * | 11/2005 | Mizuno et al. | 271/109 |
| 7,344,133 | B2 * | 3/2008 | Miki | 271/122 |
| 7,392,980 | B2 * | 7/2008 | Takeuchi et al. | 271/125 |
| 7,481,421 | B2 * | 1/2009 | Tsukamoto et al. | 271/110 |
| 7,896,342 | B2 * | 3/2011 | Tsukamoto et al. | 271/265.04 |
| 2010/0032893 | A1 | 2/2010 | Koga et al. | |

FOREIGN PATENT DOCUMENTS

JP 5-338837 A 12/1993

* cited by examiner

*Primary Examiner* — Jeremy R Severson
(74) *Attorney, Agent, or Firm* — Fitzpatrick, Cella, Harper & Scinto

(57) ABSTRACT

The present invention provides a sheet feeding apparatus and an image forming apparatus enabling to prevent generating a dent at a retard roller. When a sheet feeding operation is started, a driving motor normally rotates, and a swing arm is moved to a first position to cause a retard roller to press to a feed roller by a C input gear and a C gear. Also, when the sheet feeding operation is finished, the driving motor reversely rotates, and the swing arm is moved to a second position to cause the retard roller to separate from the feed roller.

10 Claims, 11 Drawing Sheets

SHEET FEEDING APPARATUS AND IMAGE FORMING APPARATUS WITH RETARD ROLLER

BACKGROUND OF THE INVENTION

1. Field of the Invention

The present invention relates to a sheet feeding apparatus and an image forming apparatus and more specifically relates to a configuration to separate and feed sheets to an image forming portion one by one.

2. Description of the Related Art

Recently, an image forming apparatus such as a printer, a copying machine, or a facsimile has a sheet feeding apparatus to separate and feed sheets to an image forming portion one by one, and such a sheet feeding apparatus has a sheet separating and feeding portion to separate and feed the sheets one by one. Such a sheet feeding apparatus adopts, so to speak, a retard separating method, having a feed roller which rotates in the sheet conveying direction, a retard roller which presses the feed roller, and a torque limiter which is connected to the retard roller, as disclosed in Japanese Patent Laid-Open No. 5-338837.

A pressing force of the retard roller against the feed roller and a torque value of the torque limiter are set so that the retard roller may rotate along with the feed roller in a case where a nip portion of the feed roller and the retard roller has no sheet or only one sheet. Also, the pressing force of the retard roller against the feed roller and the torque value of the torque limiter are set so that only a sheet contacting the feed roller may be conveyed without the retard roller rotating along with the feed roller in a case where plural sheets enter into the nip portion of the feed roller and the retard roller.

FIG. 9 illustrates a configuration of a conventional sheet feeding apparatus which has a sheet separating and feeding portion in such a retard separating method. In FIG. 9, a cassette 200 stores (supports) sheets S, a side wall 203 of the cassette 200 is on the downstream side in the sheet feeding direction, and a medium plate 201 is provided in the cassette 200 to be movable in the up and down directions. The sheets S are loaded on the medium plate 201.

A pickup roller 129 feeds an uppermost sheet Sa stored in the cassette 200. A feed roller 130 is made of, for example, EPDM, and a retard roller 131 presses the feed roller 130 by a not-illustrated spring and is made of, for example, urethane.

The retard roller 131 presses the feed roller 130 to form a separating nip portion N between the retard roller 131 and the feed roller 130 in a state where a surface portion of the retard roller 131 contacting the feed roller 130 is compressed. The uppermost sheet Sa fed by the pickup roller 129 is fed to the separating nip portion N formed by the feed roller 130 and the retard roller 131. A conveyance path 303 is formed by a conveying guide 302 provided from the separating nip portion N to a pair of conveying rollers 305*a* and 305*b*.

In a case of sheet feeding in the conventional sheet feeding apparatus configured as above, the pickup roller 129 first rotates and conveys the uppermost sheet Sa stored in the cassette 200 to the separating nip portion N. In a case where only one sheet Sa is fed to the separating nip portion N, driving of the retard roller 131 is interrupted by the effect of a torque limiter, and the retard roller 131 rotates to accompany the sheet Sa, as illustrated in FIG. 10A. Thereby, the sheet Sa passes the conveyance path 303 and is conveyed.

On the other hand, in a case where plural sheets are conveyed to the separating nip portion N, the retard roller 131 does not rotate along with the feed roller 130 but rotates in a reverse direction of the sheet conveying direction of the feed roller 130 by the effect of the torque limiter. The reverse rotation of the retard roller 131 causes only one sheet Sa contacting the feed roller 130 to be conveyed and causes the other sheets to be returned to the upstream side in the sheet feeding direction by the retard roller 131 as illustrated in FIG. 10B. This can prevent multiple feed of sheets.

Meanwhile, in the conventional sheet feeding apparatus and an image forming apparatus having the same, the feed roller 130 and the retard roller 131 are abraded as use time goes by. When they are abraded much, a frictional force between a sheet S and the retard roller 131 and a torque of the torque limiter+a rotational resistance of the retard roller 131 may have relationship shown in Equation (1) shown below.

$$\text{Frictional force between sheet and retard roller} < (\text{torque of torque limiter} + \text{rotational resistance of retard roller})/\text{roller radius} \quad (1)$$

In this case, when a sheet is conveyed to the separating nip portion N, the retard roller 131 stops without being rotated to accompany the sheet conveyed by the feed roller 130. That is, an accompanying rotating failure of the retard roller 131 occurs. Nevertheless, even in a case where the retard roller 131 is in a state of the accompanying rotating failure, sheet separation and conveyance are performed if relationship in Equation (2) shown below is established when one sheet is conveyed to the separating nip portion N.

$$\text{Frictional force between feed roller and sheet} > \text{Frictional force between sheet and retard roller} \quad (2)$$

Also, sheet separation and conveyance are performed if relationship in Equation (3) shown below is established even when two or more sheets are conveyed to the separating nip portion N.

$$\text{Frictional force between sheets} < \text{Frictional force between sheet and retard roller} \quad (3)$$

Further, even in a case where the retard roller 131 is in a state of the accompanying rotating failure, a frictional force between the retard roller 131 and the feed roller 130 is larger than the frictional force between the sheet and the retard roller 131. Accordingly, relationship in Equation (4) shown below is established. Before the sheet enters the separating nip portion N, the retard roller 131 rotates, and thus the sheet enters the separating nip portion N and is conveyed.

$$\text{Frictional force between retard roller and feed roller} > (\text{torque of torque limiter} + \text{rotational resistance of retard roller})/\text{roller radius} \quad (4)$$

However, the retard roller 131 is not abraded uniformly, but abrasion of an abraded part is advanced locally when the abrasion occurs. Also, when use of the image forming apparatus is stopped, the retard roller 131 stops in a state where the specific part at which the abrasion is advanced presses the feed roller 130 more frequently, in which case a dent is generated at the specific part. When this state is maintained for a long time, the dent at the specific part becomes larger as illustrated in FIGS. 11A and 11B.

When the dent becomes larger in this manner, the rotational resistance of the retard roller 131 is increased. When the feed roller 130 rotates in this state, the surface of the retard roller is abraded. When this phenomenon is repeated, a large dent caused by the abrasion is generated only at the specific part of the retard roller 131. As a result, decrease of the left-hand side of Equation (1) and increase of the right-hand side of Equation (1) are promoted only at the specific part of the retard roller 131, and a part at which relationship in Equation (5) shown below is established is generated at an early stage.

Frictional force between retard roller and feed roller< (torque of torque limiter+rotational resistance of retard roller)/roller radius (5)

When the part having such relationship is generated, the retard roller 131 is in a stop state before a sheet enters the separating nip portion N as illustrated in FIG. 11A. This interferes with entering of the sheet S into the separating nip portion N, and a jam of the sheet S occurs before the separating nip portion N as illustrated in FIG. 11B. In this manner, when the dent is generated at the retard roller, the jam of the sheet S occurs, and the sheet cannot be separated and fed.

The present invention provides a sheet feeding apparatus and an image forming apparatus enabling to prevent generation of a dent at a retard roller.

SUMMARY OF THE INVENTION

A sheet feeding apparatus according to the present invention includes a feed roller which rotates in a sheet conveying direction, a retard roller which is provided to be rotatable in a reverse direction of the sheet conveying direction and presses to the feed roller to form with the feed roller a separating nip portion separating sheets one by one, a driving portion which rotates the retard roller in the reverse direction and in the sheet conveying direction, and a supporting portion which supports the retard roller and can move the retard roller to a first position to cause the retard roller to press to the feed roller and a second position to cause the retard roller to separate from the feed roller, wherein when the retard roller is driven in the reverse direction of the sheet conveying direction by the driving portion, a force may be generated in the supporting portion so as to cause the retard roller to press to the feed roller, and when the retard roller is driven in the sheet conveying direction by the driving portion, a force may be generated in the supporting portion so as to cause the retard roller to separate from the feed roller.

As in the present invention, when a sheet feeding operation is finished, the driving portion reversely rotates, and the supporting portion is moved to a position to cause the retard roller to separate from the feed roller. By doing so, a dent can be prevented from being generated in the retard roller, and sheets can be separated and fed in a stable manner.

Further features of the present invention will become apparent from the following description of exemplary embodiments with reference to the attached drawings.

DESCRIPTION OF THE EMBODIMENTS

Figure 1:
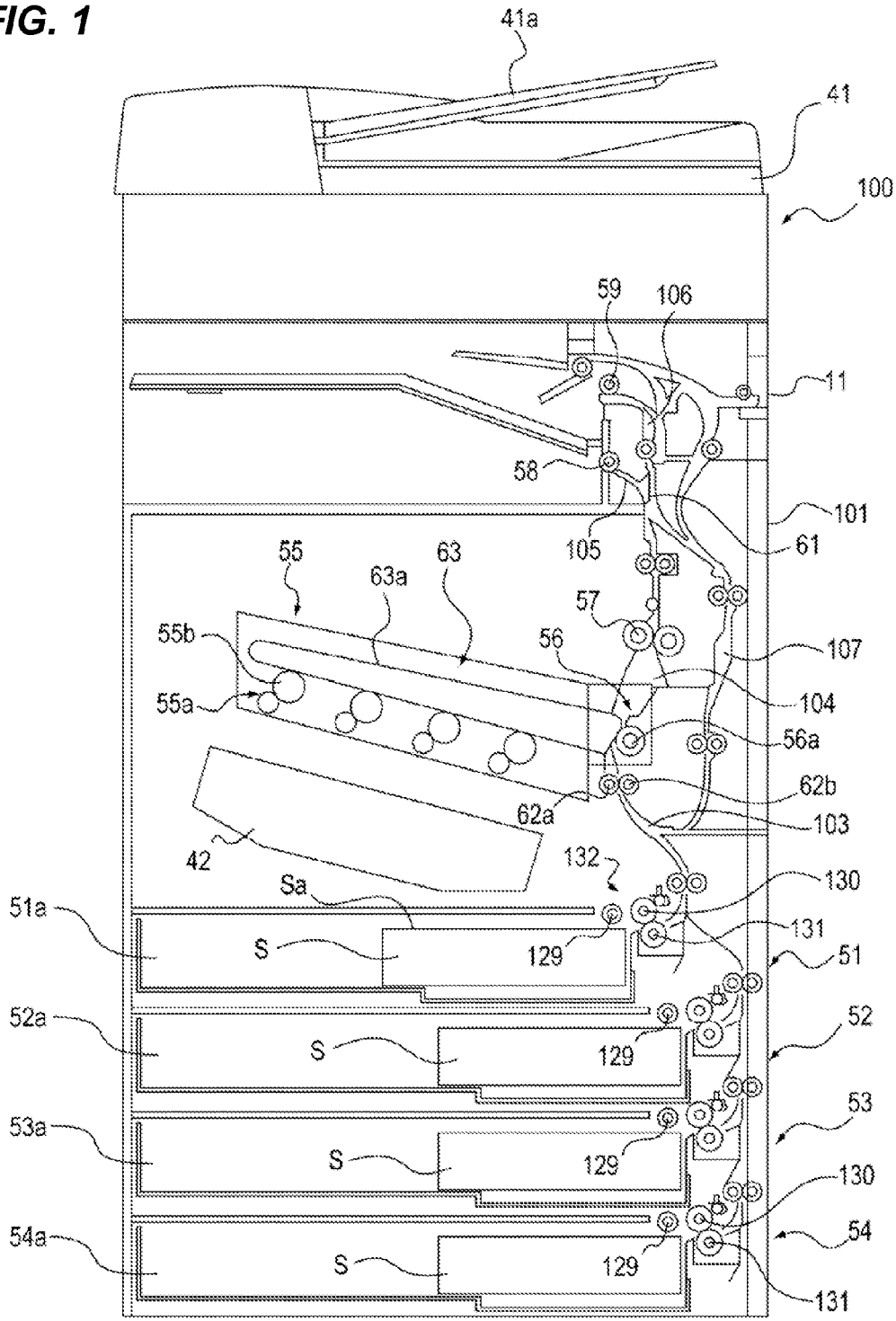
FIG. 1 is a cross-sectional view of a printer as an example of an image forming apparatus having a sheet feeding apparatus according to a first embodiment of the present invention.

Embodiments of the present invention will be described below with reference to the accompanying drawings. FIG. 1 illustrates a schematic configuration of a printer as an example of an image forming apparatus having a sheet feeding apparatus according to a first embodiment of the present invention.

In FIG. 1, a printer 100 has a printer main body 101. The upper portion of the printer main body 101 is provided with an image reading portion 41 having an image sensor or the like which irradiates an original placed on a platen glass as an original placing platen with light and converts reflected light into a digital signal. The original whose image is to be read is conveyed onto the platen glass by an automatic original feeding unit 41*a*.

Also, on the lower side of the image reading portion 41 are provided with an image forming portion 55 and sheet feeding apparatuses 51 to 54 feeding sheets S to the image forming portion 55. The image forming portion 55 has a scanner unit 42 and four process cartridges 55*a* forming toner images of four colors of yellow (Y), magenta (M), cyan (C), and black (Bk). The image forming portion 55 also has an intermediate transfer unit 63 disposed on the upper side of the process cartridges 55*a*.

Each process cartridge 55*a* has a photosensitive drum 55*b*. Also, the intermediate transfer unit 63 has not-illustrated primary transfer rollers provided inside an intermediate transfer belt 63*a* and abutting on the intermediate transfer belt 63*a* at positions opposed to the photosensitive drums 55*b*. By applying positive transfer bias to the primary transfer rollers, the toner images of the respective colors with negative polarity on the photosensitive drums are multiply-transferred to the intermediate transfer belt 63*a* sequentially. By doing so, a full-color image is formed on the intermediate transfer belt.

A secondary transfer roller 56*a* is provided at a position opposed to the intermediate transfer belt 63*a*, transfers the full-color image formed on the intermediate transfer belt to a sheet S, and forms a secondary transfer portion 56. Also, at the upper portion of the secondary transfer roller 56*a* is provided with a fixing portion 57.

The sheet feeding apparatuses 51 to 54 respectively have cassettes 51*a* to 54*a* which are sheet storage portion supporting (storing) sheets S and pickup rollers 129 which are sheet feeding rollers feeding the sheets S stored in the cassettes 51*a* to 54*a*. The sheet feeding apparatuses 51 to 54 also have sheet separating and feeding portions 132 to separate respective uppermost sheets Sa fed from the pickup rollers 129.

Figure 2:
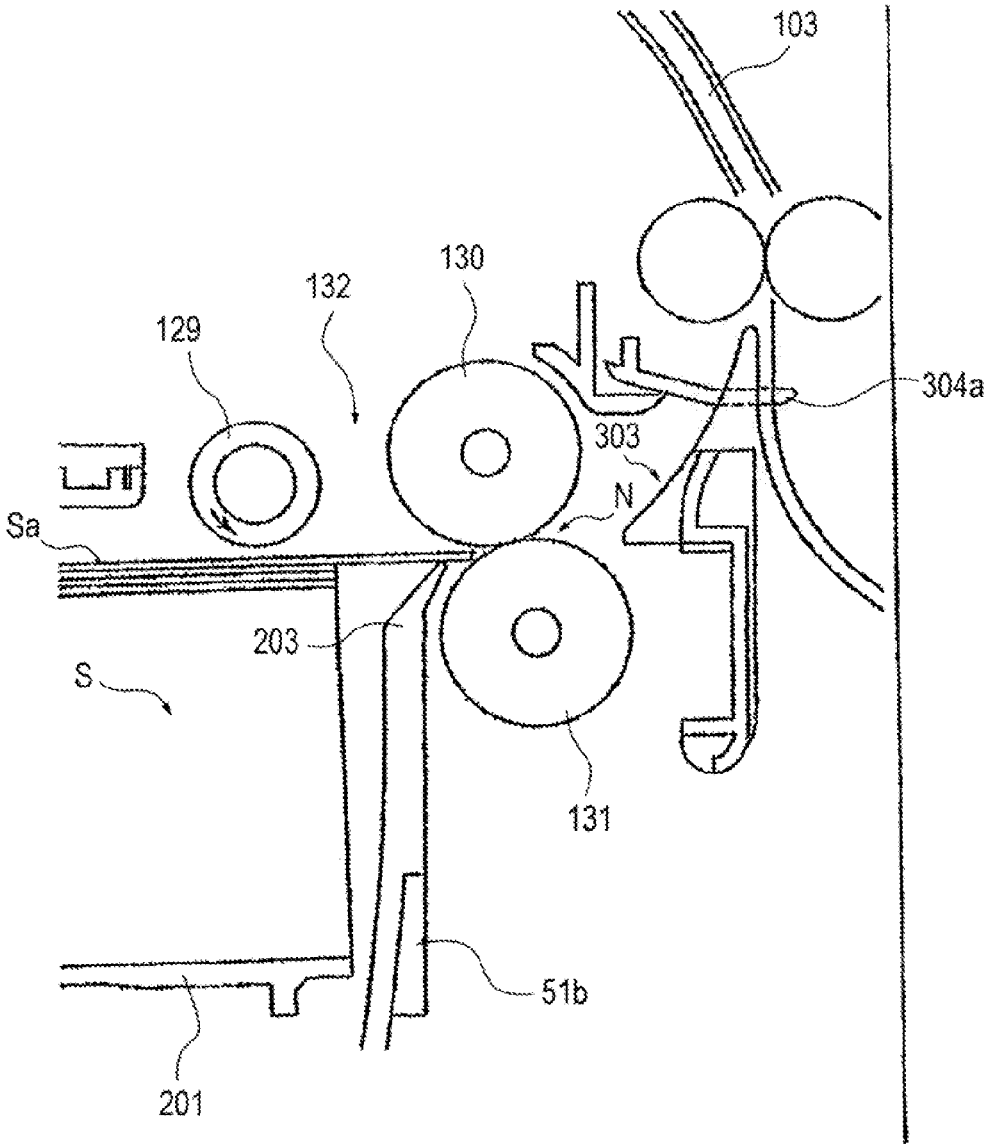
FIG. 2 illustrates a configuration of the sheet feeding apparatus.

The sheet separating and feeding portion 132 includes a feed roller 130 to convey a sheet in the sheet conveying direction and a retard roller 131 which can rotate in a reverse direction of the sheet conveying direction as illustrated in FIG. 2. In FIG. 2, a side wall 203 of each of the cassettes 51*a* to 54*a* is on the downstream side in the sheet feeding direction, and a sensor lever 304*a* is a sensor lever for a not-illustrated sheet feeding sensor to detect passing of sheets.

In FIG. 1, a conveyance path 103 conveys sheets S fed from the cassettes 51*a* to 54*a* to the secondary transfer portion 56. Conveyance paths 104 to 106 are conveyance paths from the secondary transfer portion 56 to the fixing portion 57, from the fixing portion 57 to a switching member 61, from the switching member 61 to a sheet ejecting portion 58, and from the switching member 61 to a sheet ejecting portion 59, respectively.

A re-conveyance path 107 reverses the front side and the back side of a sheet and guides it to the image forming portion 55 again to form an image on the back side of the sheet on one side of which an image is formed by the image forming portion 55. A door 11 forms a part of the conveyance paths 103 to 106 so as to enable a sheet jamming at any of the conveyance paths to be removed by opening it.

Next, an image forming operation of the printer 100 configured as above will be described. When the image forming operation is started, the scanner unit 42 first emits not-illustrated laser light based on image information from a not-illustrated personal computer or the like and sequentially exposes the surfaces of the photosensitive drums 55*b* each of whose surface is electrically charged uniformly to have predetermined polarity and potential to form electrostatic latent images on the photosensitive drums. Thereafter, these electrostatic latent images are developed by toners of yellow (Y), magenta (M), cyan (C), and black (Bk) to be visible as toner images of yellow (Y), magenta (M), cyan (C), and black (Bk). Subsequently, by transferring the toner images of the respective colors to the intermediate transfer belt 63*a* sequentially by first transfer bias applied to the first transfer rollers, a full-color toner image is formed on the intermediate transfer belt.

Also, in parallel with the toner image forming operation, the pickup roller 129 conveys an uppermost sheet Sa out of sheets S stored in one of the cassettes 51*a* to 54*a* to a separating nip portion N formed by the feed roller 130 and the retard roller 131 as illustrated in FIG. 2. The sheet Sa fed to the separating nip portion N is further conveyed by the feed roller 130 rotatable in the sheet conveying direction and the retard roller 131 rotated along with the feed roller 130.

Thereafter, the sheet Sa passes a conveyance path 303, is detected by the sheet feeding sensor by pressing up the sensor lever 304*a*, and reaches a pair of conveying rollers 305*a* and 305*b*. Further, the sheet Sa nipped by the pair of conveying rollers 305*a* and 305*b* is fed to the conveyance path 103 and is positionally adjusted at the front end thereof by abutting on a pair of registration rollers 62*a* and 62*b* which stands still.

Subsequently, the pair of registration rollers 62*a* and 62*b* is driven at timing when the full-color toner image on the intermediate transfer belt and the sheet S positionally correspond at the secondary transfer portion 56. The sheet S is thereby conveyed to the secondary transfer portion 56, and the full-color toner image is transferred onto the sheet S at a time by secondary transfer bias applied to the secondary transfer roller 56*a* at the secondary transfer portion 56.

Subsequently, the sheet S to which the full-color toner image has been transferred in such a manner is conveyed to the fixing portion 57 and receives heat and pressure at the fixing portion 57 so that the toners of the respective colors may be fused and mixed to be fixed on the sheet S as a full-color image. The sheet S on which the image has been fixed is ejected by the sheet ejecting portion 58 or 59 provided at the downstream of the fixing portion 57.

Figure 3:
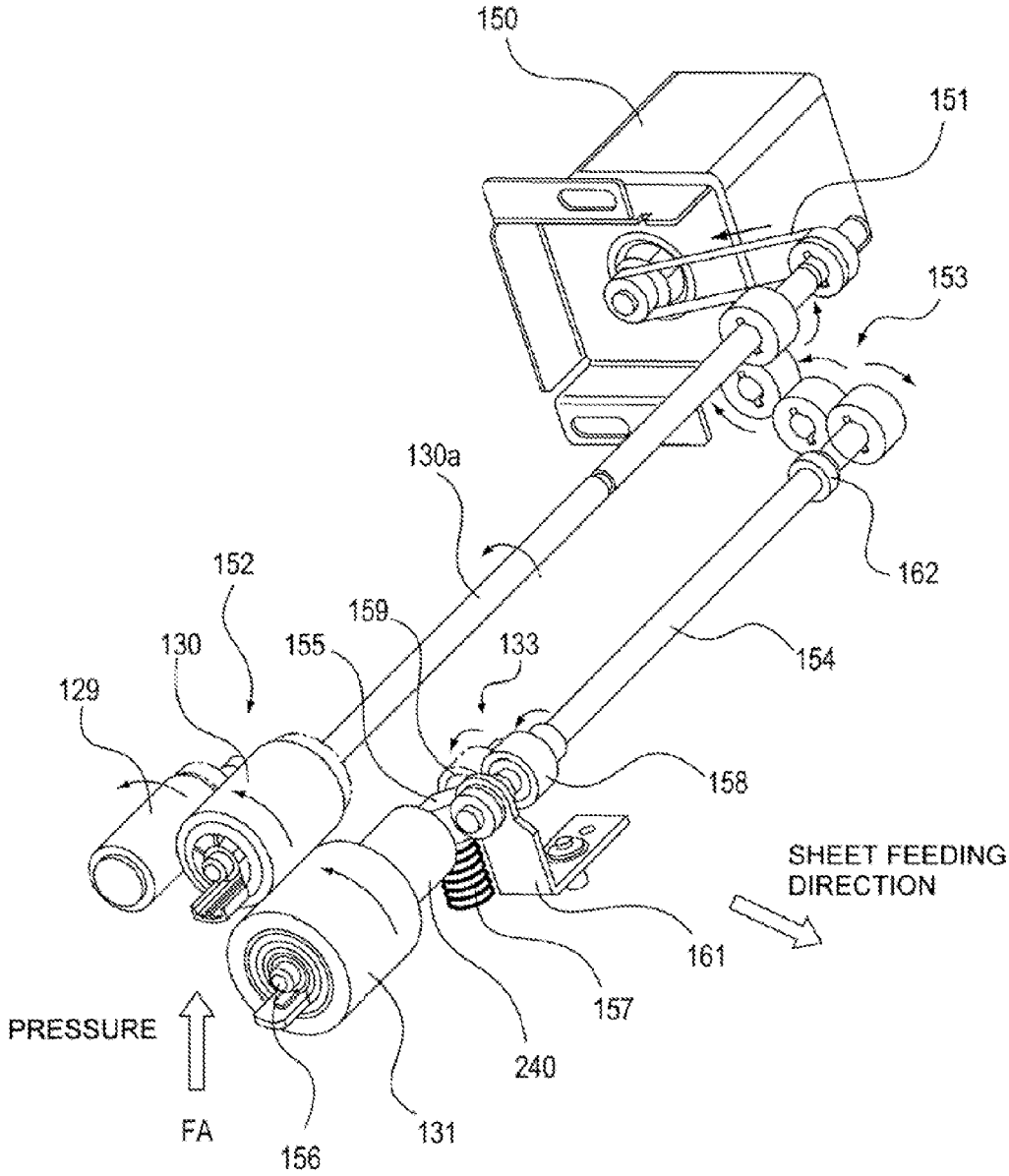
FIG. 3 illustrates a configuration of a driving transmitting system in a sheet separating and feeding portion provided in the sheet feeding apparatus.

FIG. 3 illustrates a configuration of a driving transmitting system in the sheet separating and feeding portion 132. In FIG. 3, a driving motor 150 is a driving portion enabling normal and reverse rotations installed in the printer main body, and a hybrid motor is used in the present embodiment. Also, a B shaft 130*a* is a shaft of the feed roller 130, and a C input gear shaft 154 transmits driving of the driving motor 150 to the retard roller 131.

The C input gear shaft 154 is rotatably supported at both ends thereof by supporting portions 161 and 162 and is provided at one end thereof with a swing arm 155 to be swingable which is a supporting portion supporting the retard roller 131 to enable the retard roller 131 to approach to and separate from the feed roller 130. At the swing end of the swing arm 155 is rotatably supported a C shaft 156 to which the retard roller 131 is attached at one end thereof.

In other words, in the present embodiment, the swing arm 155 supports the retard roller 131 to enable the retard roller 131 to approach to and separate from the feed roller 130 via the C shaft 156. To the lower side of the swing arm 155 is attached an auxiliary spring 157, whereby the retard roller 131 is biased in the direction of the feed roller 130. Also, one end portion of the C shaft 156 is provided with the retard roller 131 and a torque limiter 240 limiting rotations of the retard roller 131 while the other end portion is provided with a C gear 159 meshing with a C input gear 158 on the C input gear shaft 154.

FIG. 3 illustrates a state of the driving transmitting system at the time of the sheet feeding operation. At the time of the sheet feeding operation, when the driving motor 150 normally rotates (CCW direction seen from the front side of the main body), the rotation of the driving motor 150 is transmitted via a driving belt 151 to the B shaft 130*a* of the feed roller 130.

Subsequently, when the B shaft 130*a* rotates, the feed roller 130 rotates in the sheet conveying direction to convey sheets as illustrated by the arrow. Further, the rotation of the B shaft 130*a* is transmitted via a gear train 152 to the pickup roller 129, and the pickup roller 129 rotates in sheet conveying direction to convey sheets as illustrated by the arrow.

Also, when the B shaft 130*a* rotates, the C input gear shaft 154 as a first gear rotates via a gear train 153 in the CW direction seen from the front side. When the C input gear shaft 154 rotates in this manner, the C gear 159 as a second gear forming a driving transmitting portion together with the C input gear 158 rotates via the C input gear 158 in the CCW direction to cause the C shaft 156 to rotate. The retard roller 131 thereby rotates in an opposite direction of the sheet conveying direction as illustrated by the arrow.

Meanwhile, when the C gear 159 rotates in the CCW direction in response to the rotation of the C input gear 158 in the CW direction, the C gear 159 undergoes load of the torque limiter 240. When the C input gear 158 rotates under this load, a biting force is generated by gear driving of the C input gear 158 and the C gear 159. As a result, an upward force FA is generated via the C gear 159 in the C shaft 156 provided with the C gear 159.

When such an upward force FA is generated, the swing arm 155, which supports the C shaft 156 and is biased by the auxiliary spring 157, swings upward and eventually reaches a first position to cause the retard roller 131 to press the feed roller 130. That is, the swing arm 155 swings upward by the rotation force of the C input gear shaft 154 based on the reactive force of the C gear 159, which causes the retard roller 131 to press the feed roller 130.

In other words, in the present embodiment, the C input gear 158, the C gear 159, and the auxiliary spring 157 form a moving portion 133 which moves the swing arm 155 to the first position. Meanwhile, in the present embodiment, a combined force of the biting force by the gear driving and the biasing force of the auxiliary spring 157 is set to the extent that the pressing force of the feed roller 130 and the retard roller 131 required for the sheet separating and feeding operation is generated.

Also, after the sheet feeding operation is finished, the moving portion 133 is adapted to move the swing arm 155 to a second position to make the retard roller 131 separated from the feed roller 130 as described later. A biting force by this gear driving input will be described later.

In the sheet separating and feeding portion 132 having the driving transmitting system configured as above, at the time of sheet feeding, the feed roller 130 is driven to rotate in the sheet conveying direction to convey sheets while the retard roller 131 is driven to rotate in the counter sheet conveying direction. Consequently, sheets S other than an uppermost sheet fed by the pickup roller 129 are returned to the cassette side by the retard roller 131, and only the uppermost sheet is fed into the separating nip portion N.

Meanwhile, a not-illustrated one-way clutch is installed between the feed roller 130 and the B shaft 130*a*. By doing so, even in a case where delivery of driving to the feed roller 130 is stopped when the rear end of a sheet S remains on the feed roller 130 during sheet conveyance, the sheet can be conveyed to the pair of conveying rollers 305*a* and 305*b* at the downstream without load.

Figure 4:
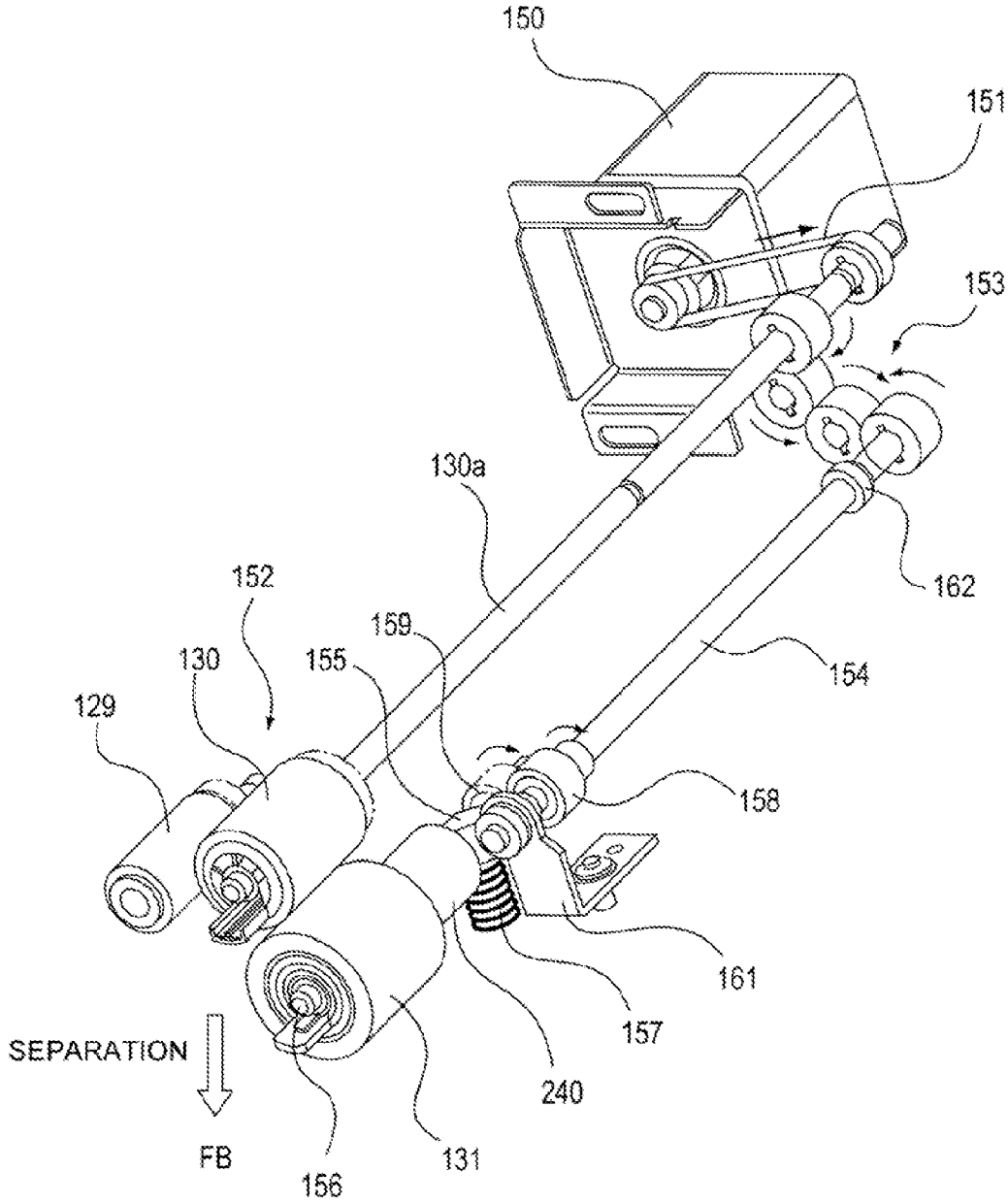
FIG. 4 illustrates a state of the driving transmitting system in the sheet separating and feeding portion when a sheet feeding job is finished.

FIG. 4 illustrates a state of the driving transmitting system in the sheet separating and feeding portion when a sheet feeding job is finished. After the sheet feeding job is finished, the driving motor 150 first reversely rotates (CW direction seen from the front side), this rotation is transmitted via the driving belt 151 and the gear train 153 to the C input gear shaft 154, and the C input gear shaft 154 rotates in the CCW direction. Subsequently, the rotation of the C input gear shaft 154 causes the C gear 159 to rotate in the CCW direction via the C input gear 158. At this moment, the C gear 159 undergoes at least the self-weights of the retard roller 131 and the swing arm 155. By the biting force by gear driving of the C input gear 158 and the C gear 159 due to the self-weights, a downward force FB is generated via the C gear 159 in the C shaft 156 provided with the C gear 159.

Figure 5:
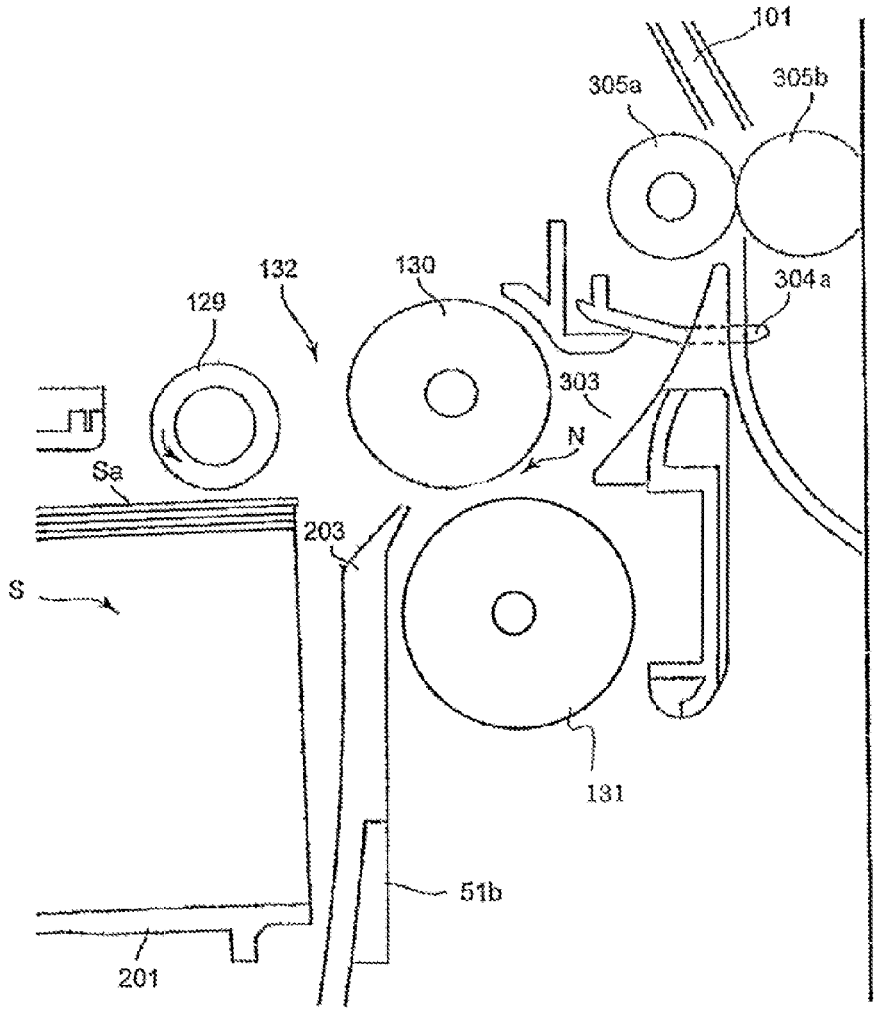
FIG. 5 illustrates the configuration of the sheet feeding apparatus.

In the present embodiment, this downward force FB is set to be larger than the biasing force of the auxiliary spring 157. Thus, when such a downward force FB is generated, the swing arm 155, which can move to the first position and the second position, swings downward, whereby the retard roller 131 separates from the feed roller 130, as illustrated in FIG. 5.

Figure 6A:
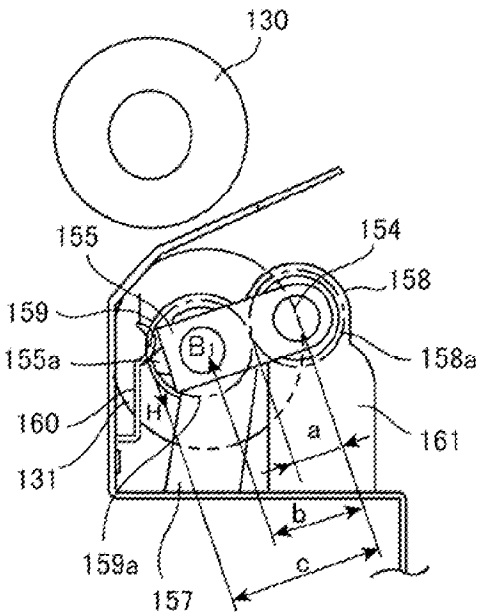
FIGS. 6A to 6C illustrate the driving transmitting system in the sheet separating and feeding portion.
Figure 6B:
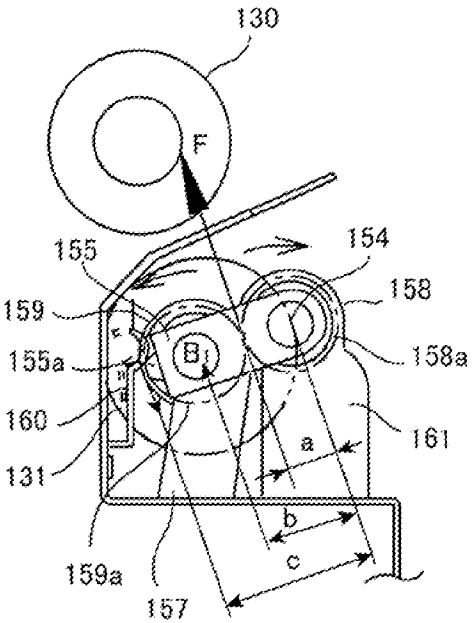
Figure 6C:
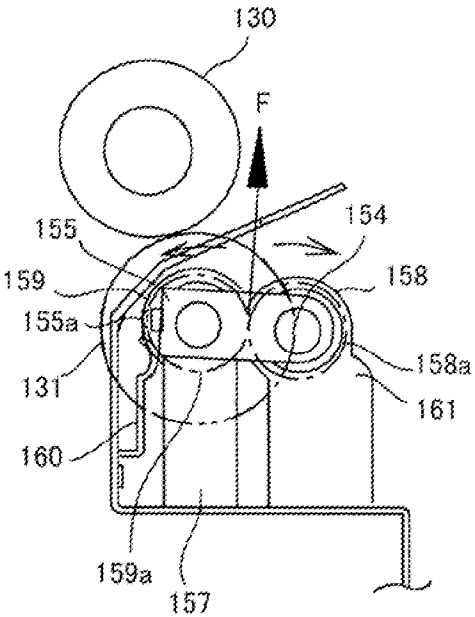

Next, a configuration to support the retard roller 131 and an operation of a driving input portion will be described in details. FIGS. 6A to 6C illustrate a pressurizing (lifting) operation of the retard roller 131 by the biting force of gear driving. In FIGS. 6A to 6C, an elastic member 160 is a holding portion and detachably holds the swing arm 155 elastically by being engaged with a protrusion 155*a* provided at the tip of the swing arm 155 to restrict lifting of the swing arm 155.

FIG. 6A illustrates an initial state at the time of an apparatus being stopped. At this time, the swing arm 155 receives an upward force B by the auxiliary spring 157, but the retard roller 131 is held in a state of separating from the feed roller 130 since the protrusion 155*a* provided at the tip of the swing arm 155 is thrust by the elastic member 160.

When the swing arm 155 is at the second position, a spring force of the auxiliary spring 157 acting on the swing arm 155 is referred to as B1. Also, a distance from the swing center of the swing arm 155 to the point of action of the auxiliary spring 157 is referred to as b, a holding force of the elastic member 160 to hold the swing arm 155 at the second position is referred to as H, and a distance from the swing center of the swing arm 155 to the point of action of the elastic member 160 is referred to as c. In this case, a conditional equation to hold a state in which the retard roller 131 separates from the feed roller 130 via the swing arm 155 is as follows in relation to moment.

$$H*c>B1*b \tag{5}$$

Subsequently, when a sheet feeding job is started, the C input gear 158 rotates in the CW direction to drive the C gear 159 in the CCW direction as described above, as illustrated in FIG. 6B. At this moment, since both the gears 158 and 159 mesh with each other at respective reference pitch circles 158*a* and 159*a*, an upward driving biting force F is generated in their tangential line direction.

When the moment acting on the swing arm 155 by this biting force F is made to surpass the holding moment of the elastic member 160, engagement of the elastic member 160 with the protrusion 155*a* of the swing arm 155 is released, and the swing arm 155 is lifted. This causes the retard roller 131 to move in a direction of the feed roller 130 and press the feed roller 130.

In a case where a reference pitch circle radius of the C input gear 158 is referred to as a, a conditional equation for the protrusion 155*a* of the swing arm 155 to elastically deform the elastic member 160 and get over the elastic member 160 by the moment acting on the swing arm 155 by the biting force F is as follows.

$$F*a+B1*b>H*c \tag{6}$$

Meanwhile, a pressing force (pressurizing force) when the retard roller 131 presses the feed roller 130 as the protrusion 155*a* of the swing arm 155 gets over the elastic member 160 is determined by the biting force F and the moment acted by the auxiliary spring 157.

Figure 7A:
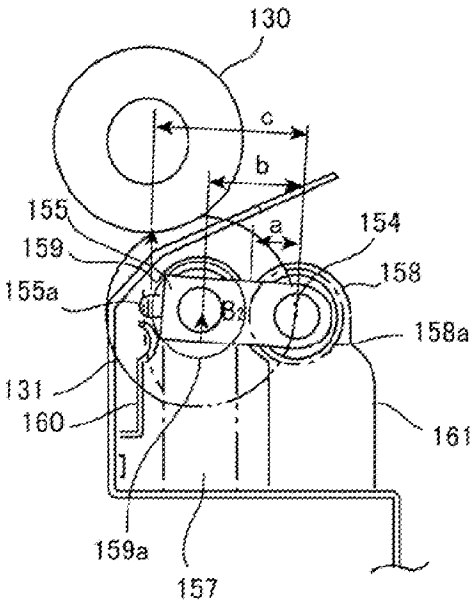
FIGS. 7A to 7C illustrate the driving transmitting system in the sheet separating and feeding portion.
Figure 7B:
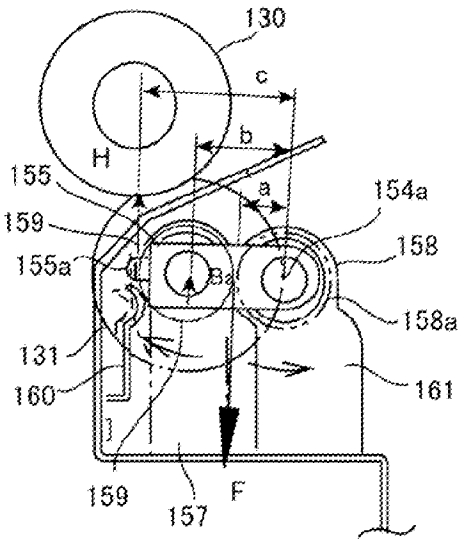
Figure 7C:
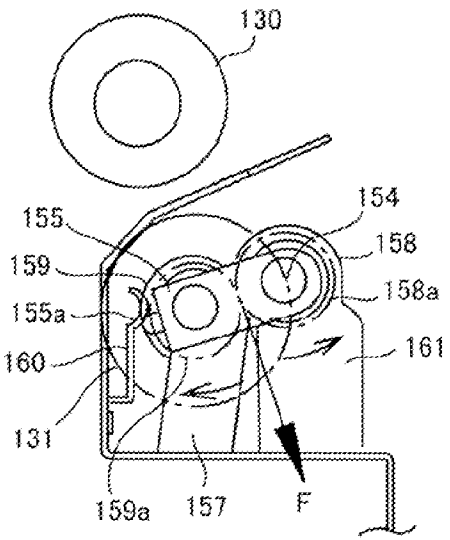

Also, FIGS. 7A to 7C illustrate a separating operation of the retard roller 131 by the biting force F of gear driving. FIG. 7A illustrates a state immediately after the sheet feeding operation is finished, in which the retard roller 131 presses the feed roller 130. As described above, the driving motor 150 reversely rotates after the end of the sheet feeding job to make the retard roller 131 separate. When the driving motor 150 starts a reverse rotation, the C input gear shaft 154 rotates in the CCW direction while the C gear 159 rotates in the CW direction as illustrated in FIG. 7B. At this moment, since both the gears 158 and 159 mesh with each other at the respective reference pitch circles 158*a* and 159*a*, the downward biting force F is generated in their tangential line direction.

When such a biting force F is generated, the swing arm 155 is biased downward, and the protrusion 155*a* in a state of getting over the elastic member 160 presses the elastic member 160 from the upper side. At this time, when the moment by the biting force F is made to surpass the holding moment acting on the protrusion 155*a* by the elastic member 160 and the moment by the spring force of the auxiliary spring 157, the protrusion 155*a* passes the elastic member 160, and the swing arm 155 swings downward. This causes the retard roller 131 to move in a direction separating from the feed roller 130.

In a case where, when the swing arm 155 is at the second position, the spring force of the auxiliary spring 157 acting on the swing arm 155 is referred to as B2, a conditional equation to cause the retard roller 131 to separate from the feed roller 130 is as follows.

$$F*a>B2*b+H*c \tag{7}$$

By satisfying this equation, the retard roller 131 can be kept separating from the feed roller 130 after the end of the sheet feeding job at all times.

In such a manner, in a case where Equation (6) described above is satisfied before the sheet feeding job is started, and Equation (7) described above is satisfied after the sheet feeding operation is finished, the retard roller 131 can be made to press the feed roller 130 only when necessary in the sheet feeding job. This prevents a specific part of the retard roller 131, of which surface is made of a softer material than that of the feed roller 130, from being kept in a state of pressing the feed roller 130 for a long time enough to generate a large dent.

Meanwhile, the movements of the retard roller 131 before the start of the sheet feeding operation and after the end of the sheet feeding job are performed by normally and reversely rotating the driving motor 150 for predetermined periods of time, respectively, and each period of time is as short as 100 to several 100 msec. Accordingly, the normal rotation and the reverse rotation can be performed at the same time as a forward rotation and a backward rotation of the main body before and after the sheet feeding operation, respectively, and will not have an adverse effect on productivity or print time of the printer.

As described above, when the sheet feeding operation is finished, the driving motor 150 reversely rotates, and the swing arm 155 is moved to the second position. By doing so, a dent can be prevented from being generated in the retard roller 131, and sheets can be separated and fed in a stable manner.

Meanwhile, there exists a conventional configuration in which the retard roller 131 is made to press the feed roller 130 when the cassettes 51*a* to 54*a* are attached. This configuration requires a complicated mechanical structure or an electric part such as solenoid in order to release the retard roller 131 when a user draws the cassette. However, the configuration of the present embodiment in which the retard roller 131 separates after the end of the sheet feeding job dispenses with a complicated pressure releasing structure as in the conventional case.

Also, in the present embodiment, the swing center of the swing arm 155 and the center of the C input gear 158 are concentric, but the embodiment is not limited to this. For example, the center of the swing arm 155 can be anywhere other than on a line connecting the center of the feed roller 130 and the center of the pressurized retard roller 131. However, in consideration of sheet passing and a mounting space for the cassettes and so on, the swing center is preferably set further on the right side than the line connecting the roller centers. Also, the C input gear 158 has only to be arranged further on the right side than the line connecting the roller centers in consideration of the inputting and rotating direction to the retard roller 131.

Figure 8:
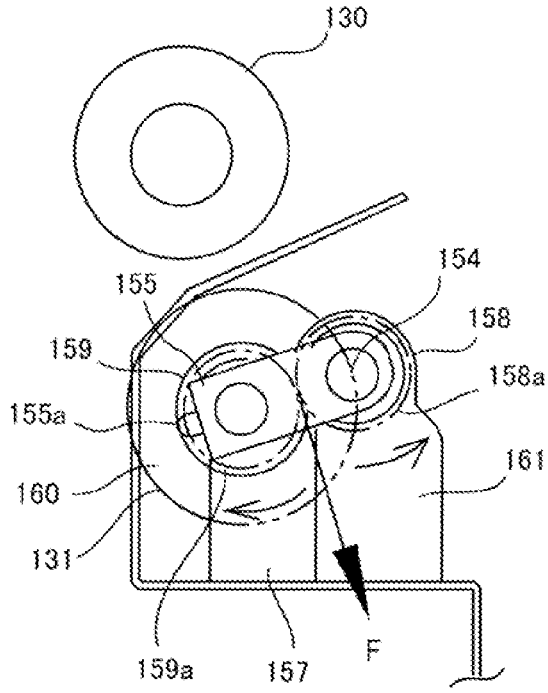
FIG. 8 illustrates a configuration of a sheet separating and feeding portion in a sheet feeding apparatus according to a second embodiment of the present invention.
Figure 9:
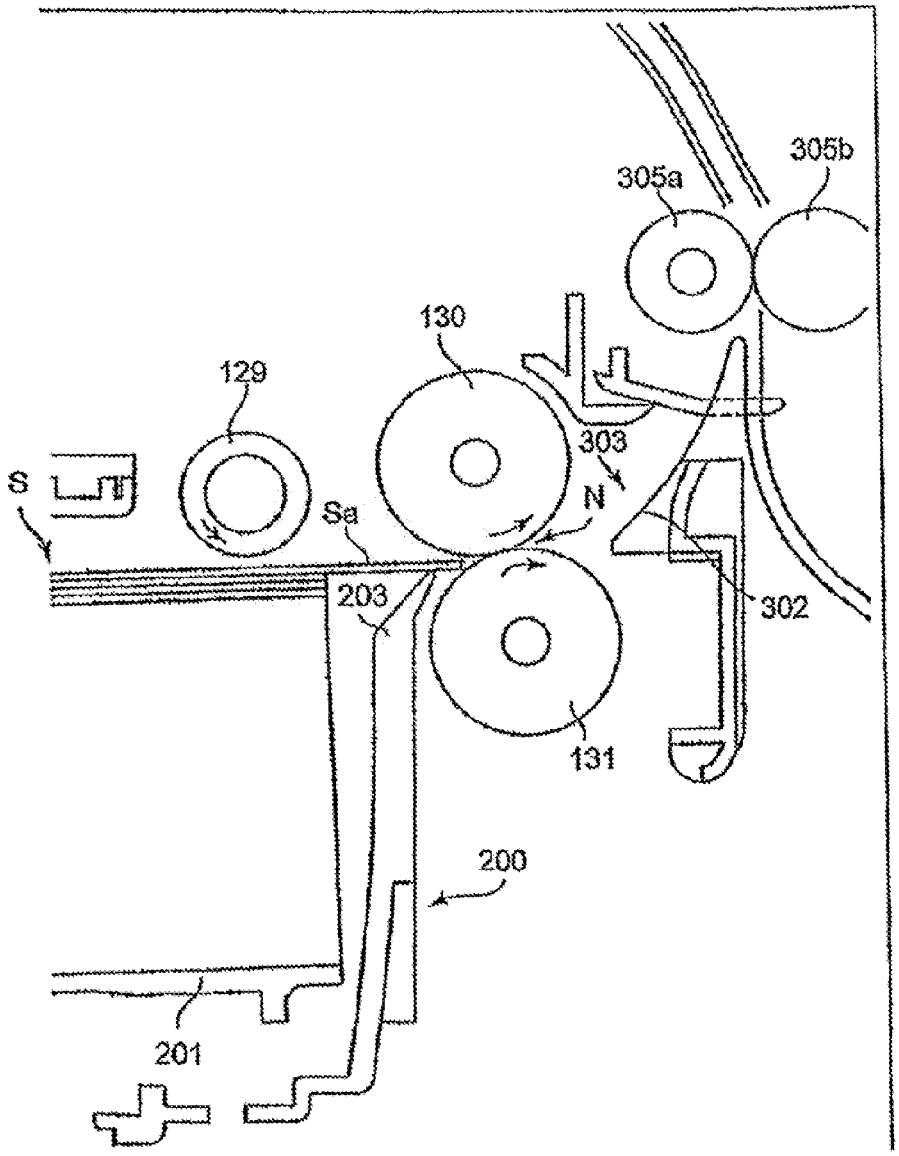
FIG. 9 PRIOR ART
FIG. 9 illustrates a configuration of a conventional sheet feeding apparatus.
Figure 10A:
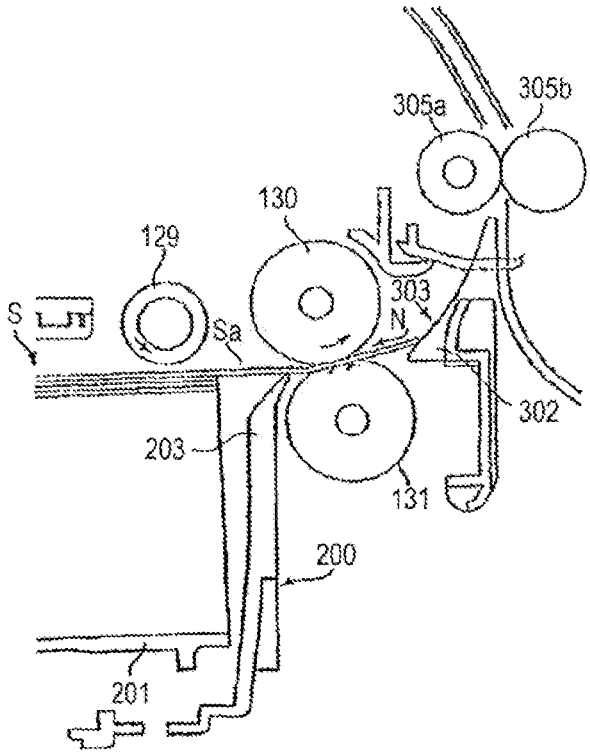
FIG. 10A PRIOR ART
FIGS. 10A and 10B illustrate a sheet feeding operation of the conventional sheet feeding apparatus.
Figure 10B:
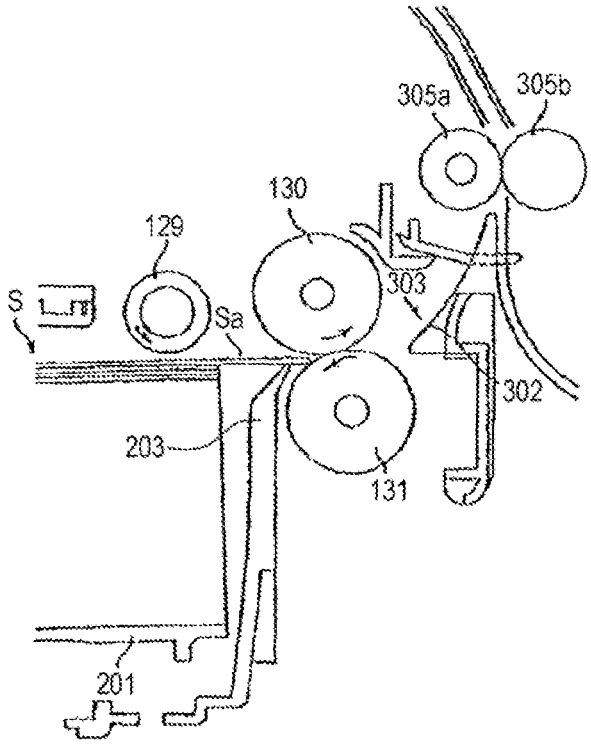
FIG. 10B PRIOR ART
Figure 11A:
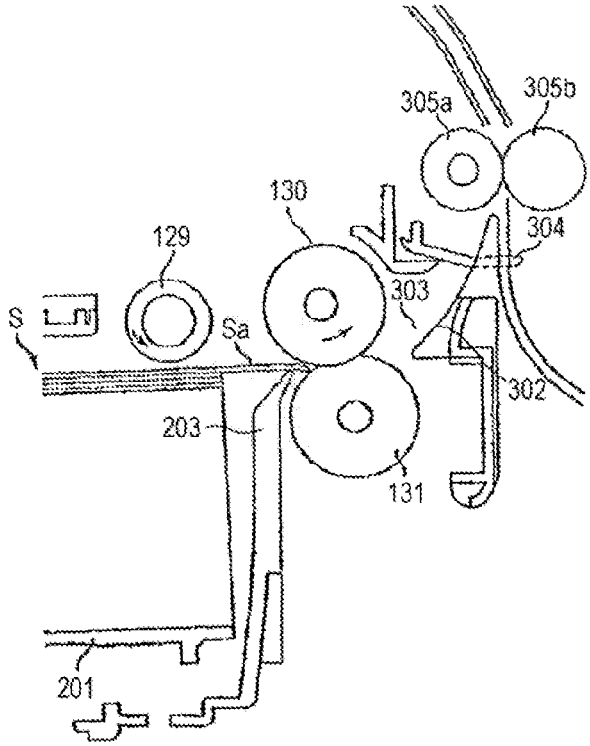
FIG. 11A PRIOR ART
FIGS. 11A and 11B illustrate the sheet feeding operation in the conventional sheet feeding apparatus.
Figure 11B:
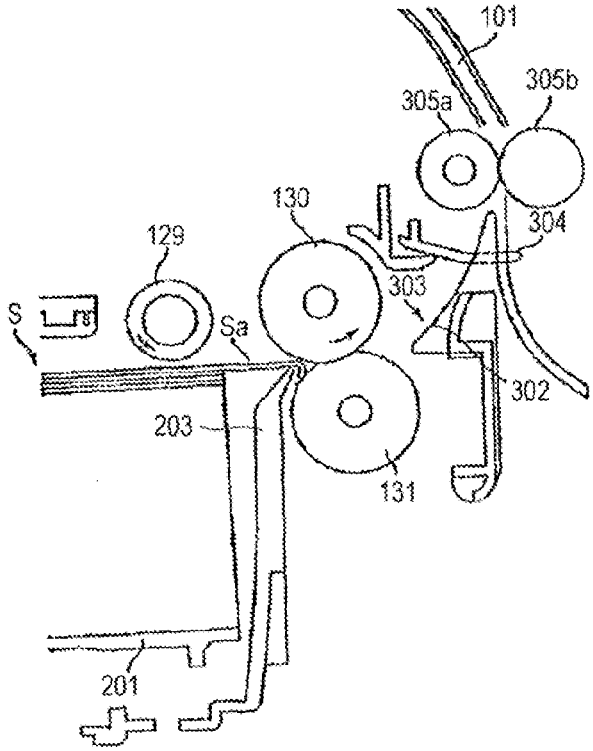
FIG. 11B PRIOR ART

Next, a second embodiment of the present invention will be described. FIG. 8 illustrates a configuration of a sheet separating and feeding portion in a sheet feeding apparatus according to the present embodiment. It is to be noted that, in FIG. 8, the same reference numerals as those in FIGS. 6A to 6C described above designate similar or identical parts.

In the present embodiment, the swing arm 155 is held at the second position to limit lifting of the swing arm 155 without using an elastic member to limit lifting of the swing arm 155. In the swing arm 155 is generated a holding torque obtained by multiplying a holding torque of the driving motor 150 itself by a reduction ratio of a drive train from the driving motor 150 to the C gear 159 when the C gear 159 is in the phase of moving the swing arm 155 to the second position. Also, a self-weight of the retard roller 131 is applied to the swing arm 155.

Thus, even in a case of a configuration without using an elastic member as in the present embodiment, setting the holding torque and the self-weight of the retard roller unit so as to surpass the biasing force of the auxiliary spring 157 can cause the swing arm 155 to be held at the second position without using an elastic member.

In this manner, in the present embodiment, the swing arm 155 is adapted to be held at the second position by the holding torque of the driving motor 150 and the self-weight of the retard roller unit. It is to be noted that the swing arm 155 may be held at the second position by at least either the holding torque of the driving motor 150 or the self-weight of the retard roller unit.

Also, in a case where separation of the retard roller 131 from the feed roller 130 is performed only by the downward biting force by gear driving, the auxiliary spring 157 is not needed as well. This can achieve a simpler configuration and can contribute to size reduction of the apparatus and cost reduction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2010-281485, filed Dec. 17, 2010, which is hereby incorporated by reference herein in its entirety.

What is claimed is:

1. A sheet feeding apparatus comprising:

a feed roller which rotates in a sheet conveying direction to feed the sheet;

a retard roller which is provided to be rotatable in a reverse direction of the sheet conveying direction and presses to the feed roller to separate sheets one by one at a separating nip portion formed with the feed roller;

a driving portion which rotates the retard roller in the reverse direction and in the sheet conveying direction;

a supporting portion, swingable supported, which supports the retard roller and can move the retard roller to a first position to cause the retard roller to press to the feed roller and a second position to cause the retard roller to separate from the feed roller; and a holding portion which detachably holds the supporting portion at the second position, wherein when the retard roller is driven in the reverse direction of the sheet conveying direction by the driving portion, a press force may be generated in the supporting portion so as to cause the retard roller to press to the feed roller, and when the retard roller is driven in the sheet conveying direction by the driving portion, a separating force may be generated in the supporting portion so as to cause the retard roller to separate from the feed roller, and the holding portion holds the supporting portion at the second position separated from the feed roller by the separation force.

2. The sheet feeding apparatus according to claim 1, further comprising:

a driving transmitting portion which has a first gear rotated by driving of the driving portion and a second gear meshing with the first gear to rotate the retard roller, wherein, when a sheet feeding operation is started, the driving portion normally rotates, and the supporting portion is moved to the first position by a rotation force of the first gear based on a reactive force of the second gear, and when the sheet feeding operation is finished, the driving portion reversely rotates, and the supporting portion is moved to the second position.

3. The sheet feeding apparatus according to claim 2, wherein the holding portion detachably holds the supporting portion elastically at the second position, and wherein the supporting portion moved to the second position along with the reverse rotation of the driving portion is held by the holding portion, and holding of the supporting portion by the holding portion is released along with the normal rotation of the driving portion.

4. The sheet feeding apparatus according to claim 2, wherein the supporting portion moved to the second position along with the reverse rotation of the driving portion is held at the second position by at least either a holding torque of the driving portion or a self-weight of the retard roller.

5. The sheet feeding apparatus according to claim 1, wherein a surface of the retard roller is made of a softer material than that of the feed roller.

6. An image forming apparatus comprising an image forming portion which forms images and a sheet feeding apparatus which feeds sheets to the image forming portion, the sheet feeding apparatus including:

a feed roller which rotates in a sheet conveying direction to feed the sheet;

a retard roller which is provided to be rotatable in a reverse direction of the sheet conveying direction and presses to the feed roller to separate sheets one by one at a separating nip portion formed with the feed roller;

a driving portion which rotates the retard roller in the reverse direction and in the sheet conveying direction; and a supporting portion, swingable supported, which supports the retard roller and can move the retard roller to a first position to cause the retard roller to press to the feed roller and a second position to cause the retard roller to separate from the feed roller; and a holding portion which detachably holds the supporting portion at the second position, wherein when the retard roller is driven in the reverse direction of the sheet conveying direction by the driving portion, a press force may be generated in the supporting portion so as to cause the retard roller to press to the feed roller, and when the retard roller is driven in the sheet conveying direction by the driving portion, a separation force may be generated in the supporting portion so as to cause the retard roller to separate from the feed roller, and the holding portion holds the supporting portion at the second position separated from the feed roller by the separation force.

7. The image forming apparatus according to claim 6, wherein the sheet feeding apparatus further includes a driving transmitting portion which has a first gear rotated by driving of the driving portion and a second gear meshing with the first gear to rotate the retard roller, and wherein, when a sheet feeding operation is started, the driving portion normally rotates, and the supporting portion is moved to the first position by a rotation force of the first gear based on a reactive force of the second gear, and when the sheet feeding operation is finished, the driving portion reversely rotates, and the supporting portion is moved to the second position.

8. The image forming apparatus according to claim 7, wherein the holding portion detachably holds the supporting portion elastically at the second position, and wherein the supporting portion moved to the second position along with the reverse rotation of the driving portion is held by the holding portion, and holding of the supporting portion by the holding portion is released along with the normal rotation of the driving portion.

9. The image forming apparatus according to claim 7, wherein the supporting portion moved to the second position along with the reverse rotation of the driving portion is held at the second position by at least either a holding torque of the driving portion or a self-weight of the retard roller.

10. The image forming apparatus according to claim 6, wherein a surface of the retard roller is made of a softer material than that of the feed roller.

* * * * *